US005191938A

United States Patent [19]

Sable et al.

[11] Patent Number: 5,191,938

[45] Date of Patent: Mar. 9, 1993

[54] ROD GUIDE ASSEMBLY AND METHOD OF ITS INSTALLATION ON A ROD SHANK

[76] Inventors: Donald E. Sable, 4301 Edmondson, Dallas, Tex. 75205; Donald E. Sable, II, 3400 Santa Monica, Denton, Tex. 76205

[21] Appl. No.: 807,601

[22] Filed: Dec. 16, 1991

[51] Int. Cl.[5] ..... E21B 17/10

[52] U.S. Cl. ..... 166/378; 166/241.3; 166/241.4

[58] Field of Search ..... 166/241.3, 241.4, 241.2, 166/241.1, 176, 175, 241.6, 378, 380

[56] References Cited

U.S. PATENT DOCUMENTS

| | | | |
|---|---|---|---|
| Re. 31,016 | 8/1982 | Oster | 166/241.3 |
| 1,552,888 | 9/1925 | Smith | 166/241.4 |
| 1,578,304 | 3/1926 | Werner | 166/241.4 X |
| 1,605,316 | 11/1926 | Wilson | 166/241.2 |
| 1,888,588 | 11/1932 | Edwards | 166/241.4 |
| 2,127,796 | 8/1938 | Willis | 166/241.3 |
| 2,200,758 | 5/1940 | Thaheld | 166/241.4 |
| 3,560,060 | 2/1971 | Morris | 166/241.4 |
| 4,050,514 | 9/1977 | Prenn | 166/176 |
| 4,575,163 | 3/1986 | Sable | 166/241.4 X |
| 4,757,861 | 7/1988 | Klyne | 166/241.3 |

*Primary Examiner*—Hoang C. Dang

[57] ABSTRACT

A rod guide assembly having a mount moulded on the rod guide shank and a centralizer rotatably mounted on the mount and the method of installing the assembly on a rod guide shank.

10 Claims, 2 Drawing Sheets

FIG. 2
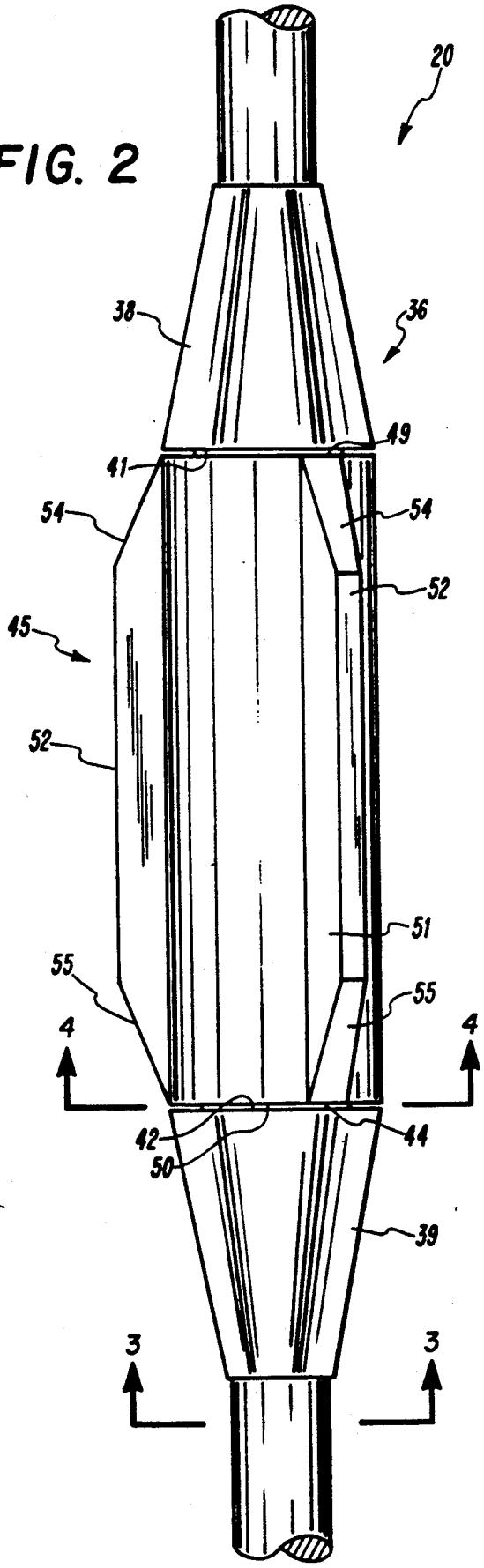
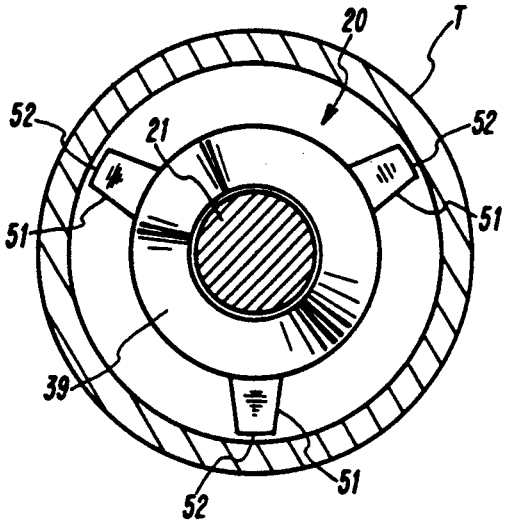
FIG. 3
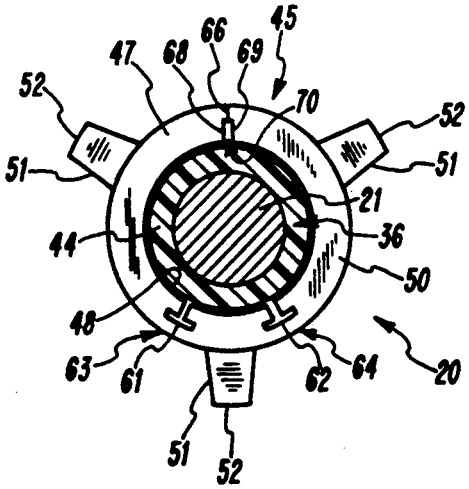
FIG. 4

ROD GUIDE ASSEMBLY AND METHOD OF ITS INSTALLATION ON A ROD SHANK

This invention relates to rod guide assemblies, to centralizers of the assemblies and to a method for installing the rod guide assemblies on the shanks of the sucker rods of a rotatable sucker rod string used to operate a well pump.

BACKGROUND OF THE INVENTION

Sub-surface well pumps of the progressive cavity type are operated to pump well fluids to the surface through a production tubing by a sucker rod string which is rotated at the well head by a suitable drive means. Ths sucker rod string, whose bottom end is connected to the rotor of the pump, comprises a plurality of serially connected sucker rods of relatively great lengths, twenty-five to thirty feet long. Since the well bore and the tubing to whose bottom end the stator of the pump is connected, are not perfectly perpendicular, it is necessary to mount rod guides or centralizers on the shanks of some, if not all, of the rods of the string to prevent or minimize damage or wear to the rods and to the tubing at locations where the rods would otherwise engage and rub against the tubing.

To minimize wear and damage to such rod guides or centralizers and to the tubing, it is desirable that the sucker rods on which the centralizers are mounted be relatively free to rotate relative to the centralizers if and when the centralizers are forced into engagement with the internal surfaces of the tubing so that the centralizers not rotate relative to the tubing and rub there against.

It is also desirable that the centralizers not rub against the metal of the sucker rods themselves since such contact would remove the corrosion preventing or inhibiting coating with which the rods are protected from the corroding effects of the well fluids being pumped and thus expose the bare metal of the rods to the well fluids.

The need for such rod guides or centralizers is well known and various devices, as disclosed in the U.S. Pat. Nos. 31,016 to Clarence Oster and 1,605,316 to R. A. Wilson, have been designed but such prior art devices are not mountable at one or more selected locations on the shank of a sucker rod and moreover expose metal surfaces of the string to the well fluids.

OBJECTS OF THE INVENTION

It is therefore an object of this invention to provide a new and improved rod guide assembly which is installable on the shank of a sucker rod.

It is another object to provide a rod guide assembly, of the type described, having a tubular mount rigidly secured to and on the shank of a sucker rod and a centralizer rotatably positioned on the mount and held against longitudinal displacement therefrom.

It is another object to provide a rod guide assembly, of the type described, wherein the mount and the centralizer are of non-metallic substances and are substantially impervious to chemical corrosive action of the well fluids to which they may be exposed when in use.

It is an important object of this invention to provide a new and improved centralizer which is positionable on the mount of a rod guide assembly moulded on a rod shank.

It is another object to provide a centralizer, of the type described, having a split tubular body which can be resiliently flexed to pass over the mount and move resiliently about the mount.

It is another important object of the invention to provide a new and improved method of installing a sucker rod guide assembly on the shank of a sucker rod.

It is another object to provide a method, of the type described, wherein the method includes rigidly securing a mount on the rod and then rotatably mounting a centralizer on the mount.

SUMMARY OF THE INVENTION

A rotary guide assembly for a sucker rod having a tubular mount rigid with and on the shank of the rod providing a cylindrical bushing portion and spaced stop means at opposite ends of the bushing portion, and a centralizer rotatably positioned about the bushing portion and between the spaced stop means.

A method for installing a rod guide means on the shank of a sucker rod by moulding a mount on the shank and then positioning a centralizer on the mount for rotation thereon.

DESCRIPTION OF THE DRAWINGS

Other objects and advantages of the invention will be readily apparent from the reading of the following descriptions of rotary guide assemblies constructed in accordance with and employing the method of the invention and reference to the accompanying drawings, wherein:

FIG. 2 is a longitudinal view of the rod guide assembly mounted on the shank of a sucker rod;

FIG. 3 is a sectional view taken on line 3—3 of FIG. 2;

FIG. 4 is a sectional view taken on line 4—4 of FIG. 2;

Figure 1:
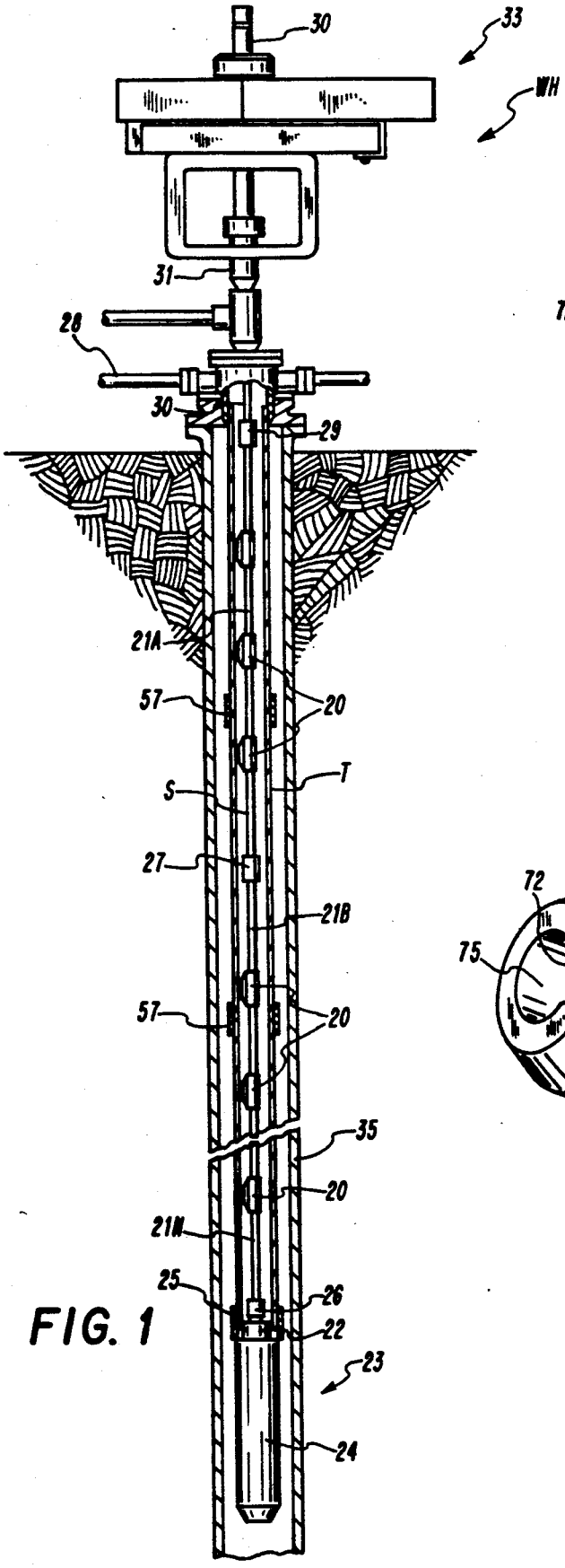
FIG. 1 is a schematic, partly sectional view of a well having a rotatable sucker rod string whose rods are provided with the rod guide assemblies of the invention.

Referring now particularly to the FIGS. 1 through 4 of the drawings, the rod guide assemblies 20 embodying the invention are shown mounted on the sucker rods 21*a*–21*n* of a sucker rod string S which extends through the well production tubing T to rotate the rotor 22 of a progressive cavity pump 23 whose stator 24 is connected to the bottom end of the production tubing T by a coupling 25. The bottom end of the lowermost sucker rod 21*n* is connected to the rotor by a coupling 26. Adjacent enlarged connector end portions of adjacent sucker rods are connected by couplings 27.

The top end of the tubing is connected to the usual well head WH, and the well fluids pumped from the well by the pump 23 flow to a reservoir tank or pipeline through the outlet pipe 28 of the well head.

The uppermost sucker rod is connected by a suitable coupling 29 to a polished rod which extends through a stuffing box 31 which seals between the well head and the polished rod. A suitable drive means 33 rotates the polished rod and therefore the sucker rod string. The well also has a casing 35 which extends from the well head through the well bore and whose lower end or lower end portion is in fluid flow communication with well fluid producing earth formations.

The well head, sucker rods, drive means and pump being of conventional well known types, will not be described in greater detail.

Since the production tubing and the sucker rod string are not perfectly concentric and perfectly perpendicular throughout their lengths due to deviations of the well bore, bending of the tubing or the sucker rod string, and the like, the sucker-rod string at some locations in the production tubing would frictionally engage the internal surfaces of the production tubing with consequent damage to both the tubing and the sucker rod string, if the sucker rods were not provided with the rod guide assemblies 20.

Each of the rod guide assemblies has a tubular guide mount 36 which is moulded on the rod and is rigid therewith. The mount may be of any suitable hard, durable plastic such as is available commercially under the trademark "RYTON". The amount is of relatively long length to provide a large area of contact with and adherence to the rod and therefore a great resistance to any forces tending to displace or move the mount relative to and on the rod.

The mount 36 is provided at its opposite ends with upper and lower end portions 38 and 39 which extend upwardly and downwardly divergently to the rod from the facing longitudinally spaced annular stop shoulders or surfaces 41 and 42, respectively. The longitudinal central bushing portion 44 of the mount between the stop shoulders is concentric with the rod and provides a smooth longitudinal circular or cylindrical slide surface for the rotatable guide or centralizer 45 disposed about the bushing portion between the stop shoulders 41 and 42 and is of slightly shorter length than the distance between the stop shoulders 41 and 42.

The centralizer 45 has a central tubular body 47 whose surface 48 has an internal diameter slightly greater than the external diameter of the mount central brushing portions 44 and is of shorter length than the distance between the facing stop surfaces 41 and 42 of the mount 36.

The centralizer may rotate freely on the mount but is held against longitudinal displacement from the mount by the engagement of its opposite end surfaces 49 and 50 with the mount stop shoulders 41 and 42, respectively.

The centralizer is provided with three or more circumferentially spaced, radially outwardly extending longitudinal ribs 51 whose outer longitudinal surfaces 52 lie in a cylindrical plane of slightly smaller diameter than the interval diameter of the production tubing T, FIG. 3. The ribs have beveled outwardly convergent top and bottom surfaces 54 and 55, respectively, to facilitate movement of the guide assembly past upwardly and downwardly facing obstructions of the tubing, as at the couplings 57 connecting adjacent ends of adjacent sections of the tubing, and also to minimize turbulence in the well fluids as they flow upwardly in the tubing during the operation of the pump. The outer surfaces of the end portions are also beveled (converge outwardly toward each other from the rod) for the same reasons.

The rotary guide or centralizer 45 is formed of any suitable tough, durable, abrasion resistant, somewhat resilient substance, such as the plastic commercially available under the trademark "NYLON" and its body 47 is provided (FIG. 4) throughout its length with longitudinal, T-shaped in cross-section, grooves 61 and 62 which provide longitudinal flex sections 63 and 64, the grooves inner ends opening to the internal surfaces 48 of the mount body, which being of decreased thickness may yield or flex resiliently to permit portions of the body on opposite sides of the longitudinal slit 66, which is positioned substantially diametrically opposite the slots, to be moved outwardly in opposite directions as the centralizer is positioned on the bushing portion 44 of the mount. These centralizer body portions then move resiliently inwardly to the positions on the mount illustrated in the drawings.

The slit is enlarged at its inner end portion, as at the sides 68 and 69, to provide a longitudinal recess 70 for receiving any inflow of the substance of which the centralizer is formed, and prevent its reaching the internal surfaces if the sides 68 and 69 of the mount body at the slit are welded together, as by application of heat thereto if the substance is thermoplastic or of a chemical which temporarily melts the centralizer substance the abutting surfaces defining the slit. In the event bonding or adhesive agent is used to secure the abutting surfaces to one another, such recess may receive any excess of such agent to prevent it from reaching the internal surface 48.

It will be apparent that if it is desired to weld the abutting surfaces of the centralizer to one another after the centralizer is positioned on the mount, the slit is preferably in a downwardly opening position during the welding operation so any molten or liquid material will not flow upwardly to the internal surface 48 of the centralizer.

The terms "weld" or "welding" as used herein are meant to define any connection or operation by which the abutting surfaces defining the slit 66 are connected or joined so that the tubular body 47, when it is in place on the amount, becomes a solid tubular body with no slit.

It will be apparent to those skilled in the art that once the rods on which the rotary guide assemblies are in the production tubing, the tubing itself will tend to prevent any lateral displacement of the centralizer from the mount. The welding of the abutting adjacent surfaces define the slit so that the mount becomes a solid body with no slit is desirable mainly to prevent dislodgment of the centralizer mounts due to forces applied thereto by negligence or accident during the transport, storage and installation in or removal from the production tubing of the sucker rods after the rod guide assemblies have been mounted thereon.

The centralizer may also be moulded and its internal surface 48 may be, if necessary, smoothed or polished so that the centralizer may freely slidably rotate with minimal friction on the mount bushing portion 44.

A preferred method for installing each rod guide assembly includes stripping and cleaning the portion of the shank of the sucker rod of any dirt or coating, such as a coating of a corrosion resisting or inhibiting substance with which the sucker rod is ordinarily coated, the particular coating substance varying with the nature of the fluids of the well in which the sucker rod is to be used; rigidly securing, as by moulding, the mount 36 on such cleaned section of the rod shank; smoothing or polishing, if necessary, the intenval surface 48 of the centralizer and the bushing portion 44 and stop surfaces 41 and 42 of the mount; and positioning the centralizer about the mount on the bushing portion and between the stop surfaces by resiliently flexing outwardly opposed portions of the centralizer at opposite sides of its slit 66, preferably at narrowed flex portions 63 and 64 thereof at locations opposed and spaced from the slit 66, to form a longitudinal passage for passing over the bushing portion 44 as the centralizer is moved onto the bushing portion of the mount 36 between the stop shoulders 41 and 42 of the mount.

The installation method may also include welding, as defined herein above, adjacent longitudinal surfaces of the centralizer defining the slit 66 after the centralizer is positioned on the mount whereby the centralizer constitutes a solid tubular body rotatable on the bushing portion of the mount.

It will now be apparent that the sucker rods of a sucker rod string at required locations along the string, may be provided with one or more of the rod guide assemblies embodying the invention and installed thereon by the method of the invention, and that these assemblies permit easy rotation of the rod shanks on which they are mounted relative to the centralizers which are slidably rotatable on the mounts of the assemblies which are rigid with the rod shanks, to minimize the force required to rotate the sucker rod string even though the ribs of the centralizers may engage the internal surfaces of the tubing and hold the centralizer against rotation in the tubing.

It will further be seen that the mounts being relatively free to rotate relative to the centralizers, the ribs of the centralizers will not be rubbed or dragged along the internal surfaces of the production tubing during the rotation of the sucker rod string, since any engagement of the centralizer ribs with this tubing will stop rotation of the centralizers thus minimizing wear or damage to not only the centralizers, but also the tubing because the friction between the bushing portion of the mount and the centralizer will exert a much smaller surface tending to resist rotation of the mount relative to the centralizer than the force tending to resist rotation of the centralizer relative to the tubing when one or more centralizer ribs engage the internal surfaces of the tubing not only because the frictional resistance between the mount and the centralizer is relatively low, but also because during the rotating of the sucker rod string the moment arm of the force exerted on the centralizer by the bushing portion at the area of frictional engagement therebetween is much shorter than the moment arm of the force exerted on the centralizer at the area of the frictional engagement of one or more of its ribs with the internal surfaces of the tubing.

It will be apparent that while a preferred form of the centralizers for use with the mounts has been illustrated, centralizers of different structures may be rotatably installed on the mounts without departing from the invention.

Figure 6:
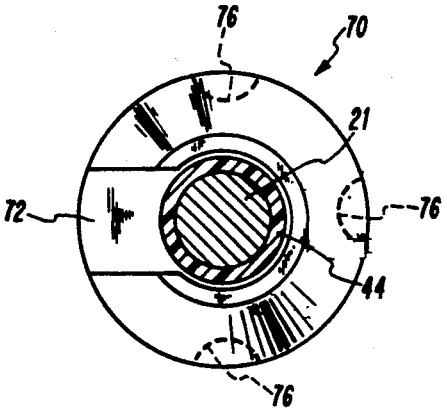
Figure 5:
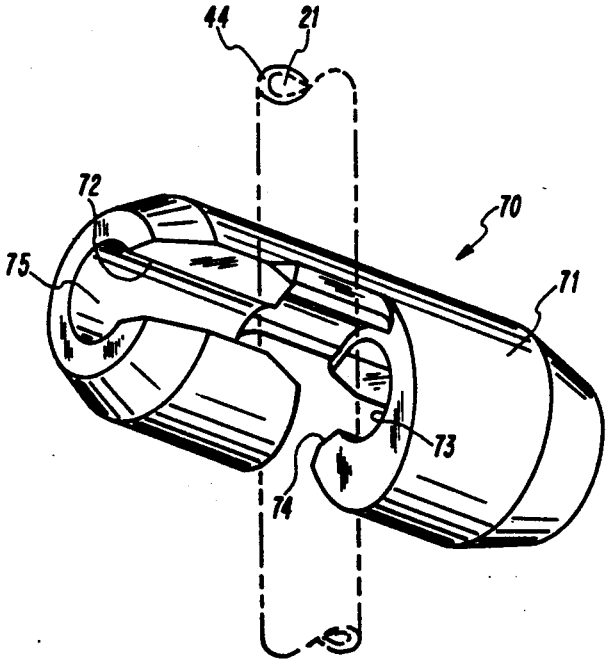
FIG. 5 is a perspective view of another form of the centralizer of the rotary guide assembly embodying the invention; and, FIG. 6 is a cross sectional view of a sucker rod shank on whose mount the centralizer of FIG. 5 is mounted.

For example, as shown in FIGS. 5 and 6, centralizers 70 having substantially the structure of the "snap on" guide shown in the U.S. Letters Patent to Donald E. Sable, U.S. Pat. No. 4,575,163, issued Mar. 11, 1986, may be used with the mount. Such centralizers have a tubular body 71 provided with diametrically opposed longitudinal slots 72 and 73 connected at their inner ends by a transverse slot 74. The lontitudinal central bore 75 would of course be of a diameter slightly greater than the diameter of the bushing portion 44 of the mount. Such "snap on" centralizer is installed on the bushing portion 44 of the mount as described in the above mentioned patent by moving the body 71 on the bushing portion by means of the transverse slot 74 and then rotating the centralizer about an axis perpendicular to the axis of the longitudinal bore of the centralizer, clockwise as seen in FIG. 5, the bushing portion 44 being received and passed through the longitudinal slots 72 and 73 of the body 70 as the portions of the body flex resiliently to permit such movement.

The body 70 could be provided with external longitudinal grooves 76, FIG. 6, so that it would provide a greater effective flow passage between the tubing and itself. The "snap on" centralizer would be held on the mount not only by its own resilient force which would resist rotation of the centralizer about an axis perpendicular to the longitudinal axis of its bore 75 once it has been installed on the mount, but also by the tubing itself which would prevent its rotation on the bushing portion 44 about such axis perpendicular to the longitudinal axis of the bushing portion.

It will be seen that both the centralizer 45 and the centralizer 70 have longitudinally split tubular bodies, the body 47 being split by the slit 66 and the body 71 being split by the slots 72, 73 and 74, so that they may be mounted on the bushing portion 44 of the mount.

The foregoing description of the invention is explanatory only and changes in the construction and method described and illustrated may be made by those skilled in the art within the scope of the appended claims without departing from the spirit of the invention.

What is claimed as new and desired to be secured by Letters Patent is:

1. A sucker rod guide assembly for the shank of a sucker rod positionable in a well tubing, said assembly including: a centralizer mount having a tubular body on and rigid with the shank of a sucker rod, said body having an elongate bushing portion having a tubular surface concentric with the longitudinal axis of the rod and end portions at opposite ends of said bushing portion extending radially outwardly of said bushing portion, said end portions having spaced facing annular stop shoulders; and a tubular centralizer rotatably disposed on said body about said bushing portion and between said stop shoulders, said stop shoulders limiting longitudinal movement of said centralizer on said bushing portion, said centralizer having a tubular body having annular opposite end surfaces engageable with said annular stop shoulders and tubing engageable means extending from said tubular body radially outwardly of said annular stop shoulders of said mount.

2. The assembly of claim 1, wherein said tubing engagebale means comprise circumferentially spaced radially outwardly extending longitudinal ribs.

3. The assembly of claim 2, wherein said ribs have bevelled end surfaces at opposite ends thereof extending divergently toward said cylindrical body portion.

4. The assembly of claim 3, wherein said end portions of said mount have annular external surfaces extending divergently inwardly from said annular stop shoulders toward the rod shank.

5. The assembly of claim 1, wherein said end portions of said mount have annular external surfaces extending divergently inwardly from said annular stop shoulders toward the rod shank.

6. The assembly of claim 5, wherein said mount is of a hard plastic and said centralizer is of a resilient plastic.

7. The assembly of claim 1, wherein said mount is of a hard plastic and said centralizer is of a resilient plastic.

8. A method of installing a rod guide assembly on the shank of a sucker rod including: moulding on the shank a centralizer mount having a longitudinal cylindrical bushing portion and spaced facing annular stop shoulders extending outwardly from opposite ends of said bushing portion; positioning an elongate centralizer having a central bore and a longitudinal slit opening to said bore about said bushing portion and between said stop shoulders by resiliently outwardly flexing portions of said centralizer from said slit and moving said centralizer onto said bushing portion until said bushing portion is positioned in said central bore.

9. The method of claim 8, wherein said slit is defined by adjacent parallel surfaces.

10. The method of claim 9 and welding said centralizer along said slit at said adjacent surfaces.

* * * * *